US006220487B1

(12) United States Patent
Srivastava et al.

(10) Patent No.: US 6,220,487 B1
(45) Date of Patent: Apr. 24, 2001

(54) DISPENSING APPARATUS

(75) Inventors: Nilendu Srivastava, Chelmsford, MA (US); Cyriac Devasia, Nashua, NH (US); Carl Ito, Scottsdale, AZ (US)

(73) Assignee: Micro Robotics Systems, Inc., N. Billerica, MA (US)

( * ) Notice: Subject to any disclaimer, the term of this patent is extended or adjusted under 35 U.S.C. 154(b) by 0 days.

(21) Appl. No.: 09/419,135

(22) Filed: Oct. 15, 1999

Related U.S. Application Data

(60) Provisional application No. 60/104,558, filed on Oct. 16, 1998.

(51) Int. Cl.[7] ..... B67D 5/40

(52) U.S. Cl. ..... 222/380; 417/466

(58) Field of Search ..... 222/504, 367, 222/380, 333; 141/256, 259, 102; 417/401, 403, 404, 398, 461, 466

(56) References Cited

U.S. PATENT DOCUMENTS

| | | | | |
|---|---|---|---|---|
| 4,033,482 | | 7/1977 | Kushner et al. | 222/136 |
| 4,223,811 | | 9/1980 | Czegledi | 222/136 |
| 4,349,130 | | 9/1982 | Bair | 222/129 |
| 4,399,932 | * | 8/1983 | Zimmernann | 222/380 |
| 4,842,162 | | 6/1989 | Merkel | 222/1 |
| 4,931,249 | | 6/1990 | Hune | 264/279 |
| 5,054,650 | | 10/1991 | Price | 222/1 |
| 5,074,443 | | 12/1991 | Fujii et al. | 222/639 |
| 5,102,030 | | 4/1992 | Tamashima et al. | 228/175 |
| 5,127,547 | * | 7/1992 | Gerich | 222/55 |
| 5,499,745 | | 3/1996 | Derian et al. | 222/136 |
| 5,819,983 | | 10/1998 | White et al. | 222/1 |
| 5,893,490 | | 4/1999 | Gnyp | 222/526 |
| 5,913,455 | | 6/1999 | La et al. | 222/55 |
| 5,927,560 | | 7/1999 | Lewis et al. | 222/263 |
| 5,957,343 | | 9/1999 | Cavallaro | 222/504 |

FOREIGN PATENT DOCUMENTS

| | | |
|---|---|---|
| 569883 | 11/1975 | (CH) . |
| 848024C | 9/1952 | (DE) . |
| 2020737 | 11/1979 | (GB) . |
| 2086993 | 5/1982 | (GB) . |

* cited by examiner

*Primary Examiner*—Kevin Shaver
*Assistant Examiner*—Melvin Caitagena
(74) *Attorney, Agent, or Firm*—George A. Herbster; Pearson & Pearson

(57) ABSTRACT

A dispensing pump includes first and second sleeve assemblies. Each sleeve assembly includes a rotary valve having an input and output position and a longitudinally displaceable piston that moves between a first position abutting the valve and a second position displaced from the valve. The sleeve connects to a manifold with input and output passages that align with input and output apertures in the sleeve. Withdrawing the piston with the input port of the valve aligned with the input aperture draws material into the sleeve. Moving the piston toward the valve in the output position with the output port aligned with the output passage displaces material from the manifold.

19 Claims, 5 Drawing Sheets

DISPENSING APPARATUS

CROSS REFERENCE TO RELATED APPLICATION

This application is a continuation of United States Provisional Application Ser. No. 60/104,558 filed Oct. 16, 1998 for a Dispensing Apparatus (abandoned).

BACKGROUND OF THE INVENTION

1. Field of the Invention

This invention generally relates to dispensing apparatus and more specifically to dispensing apparatus capable of metering predetermined amounts of a material with accuracy.

2. Description of Related Art

Conventional positive displacement pumps available today for high accuracy dispensing applications are either piston-type or rotary screw-type pumps. Both types find uses in specific applications. For example, U.S. Pat. No. 5,499,745 (1996) to Derian et al. discloses an apparatus for mixing and dispensing two chemically reactive materials. This apparatus includes a metering unit for dispensing two-part polymeric materials from a dispensing module attached to the end of the robot arm. The metering unit includes a piston located concentrically about a shaft of a dual actuating piston assembly to provide the two polymeric materials in a fixed ratio. A variable rate dispenser compensates for changes in robot velocity or viscosity changes.

U.S. Pat. No. 5,819,983 (1998) to White et al. discloses a liquid dispensing system with a sealing augering screw. The augering screw serves both a metering function and a valving function and is axially movable between a position in which fluid can flow and a sealing position in which liquid flow through the nozzle is substantially prevented. The screw has a curved contour between its threads and a plurality of thread-defining channels to allow liquid to fill more completely around the screw thereby to dispense more liquid with fewer screw turns than prior designs.

U.S. Pat. No. 5,927,560 (1999) to Lewis et al. discloses a dispensing pump that dispenses a two-part epoxy and includes a pumping chamber in communication with a nozzle by means of a three-way valve. The pumping chamber includes an outlet, an internal volume, a pair of spaced directional seals located away from the outlet, an open volume residing between the seals and an external port opening the open volume to atmosphere. A stepped plunger extends axially within the pumping chamber. A first portion is sized to be received and aligned through a first directional seal so the plunger can move the first portion toward the outlet to close off the internal volume at the second seal. The second plunger portion is relatively smaller and transfers cross-sectional dimension than the inside diameter of the second seal to cooperate with the port to promote fluid removal from the internal volume during initial filling and priming of the pumping chamber. Once filled and primed, the plunger causes positive volume displacement of liquid from the pumping chamber and out of the nozzle, with very good repeatability and high fluid flow rates, independent of material viscosity, and/or temperature or viscosity changes. For refilling, the plunger is retracted by a volume which corresponds to the volume of material refilled into the internal volume.

U.S. Pat. No. 5,957,343 (1999) to Cavallaro discloses a controllable liquid dispensing device with a selectively adjustable material control device and a sealing device with a dispensing device. The sealing device is in communication with a switching device to move the sealing device between a first position and a second position. The first position of the sealing device allows the material control device to draw a volume of material into the dispensing device. The second position of the sealing device allows the material control device to force the volume of material to dispense from the dispensing device.

The foregoing patents disclose a number of possible approaches to various dispensing devices. However, they are not the best choices for many high accuracy and high throughput applications. Many such applications use high viscosity abrasive fluids that further exacerbate the problem because the materials tend to wear and increase the force or torque needed to drive the system to dispense material. Screw-type pumps lack the accuracy or the throughput needed for today's production processes. Although piston pumps offer better volumetric accuracy, they lack any feedback capability and are also slow. Piston pumps further generally have a large size, are difficult to use and impose real restrictions on the end user.

SUMMARY

Therefore it is an object of this invention to provide a positive displacement dispensing pump that meets high volume production demands.

In accordance with one aspect of this invention, a dispensing pump comprises a sleeve, a valve, a piston and a control. The sleeve has first and second ends and first and second spaced apertures through a side thereof. The valve mounts for rotation internally at a first end of the sleeve with first and second ports for alignment with the first and second apertures in first and second angular positions of the valve, respectively. The piston mounts at the other end of the sleeve for longitudinal motion between a first position abutting the valve and a second position displaced from the valve. The control rotates the valve and displaces the piston thereby to dispense a material from one of the spaced apertures.

In accordance with another aspect of this invention, a dispensing pump includes a manifold having an input port for connection to a material source, an output port and first and second input and output passages wherein the input passages connect to the input port and the output passages connect to the output port. Each of first and second sleeve assemblies attach to communicate with one pair of the input and output passages; each sleeve assembly has a structure for displacing material. An operator interacts with the displacing structure for moving material from the material source through the input passages and input ports into the sleeve assemblies and for moving material from the sleeve assemblies through the output ports and output passages.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE ILLUSTRATIVE EMBODIMENTS

Figure 1:
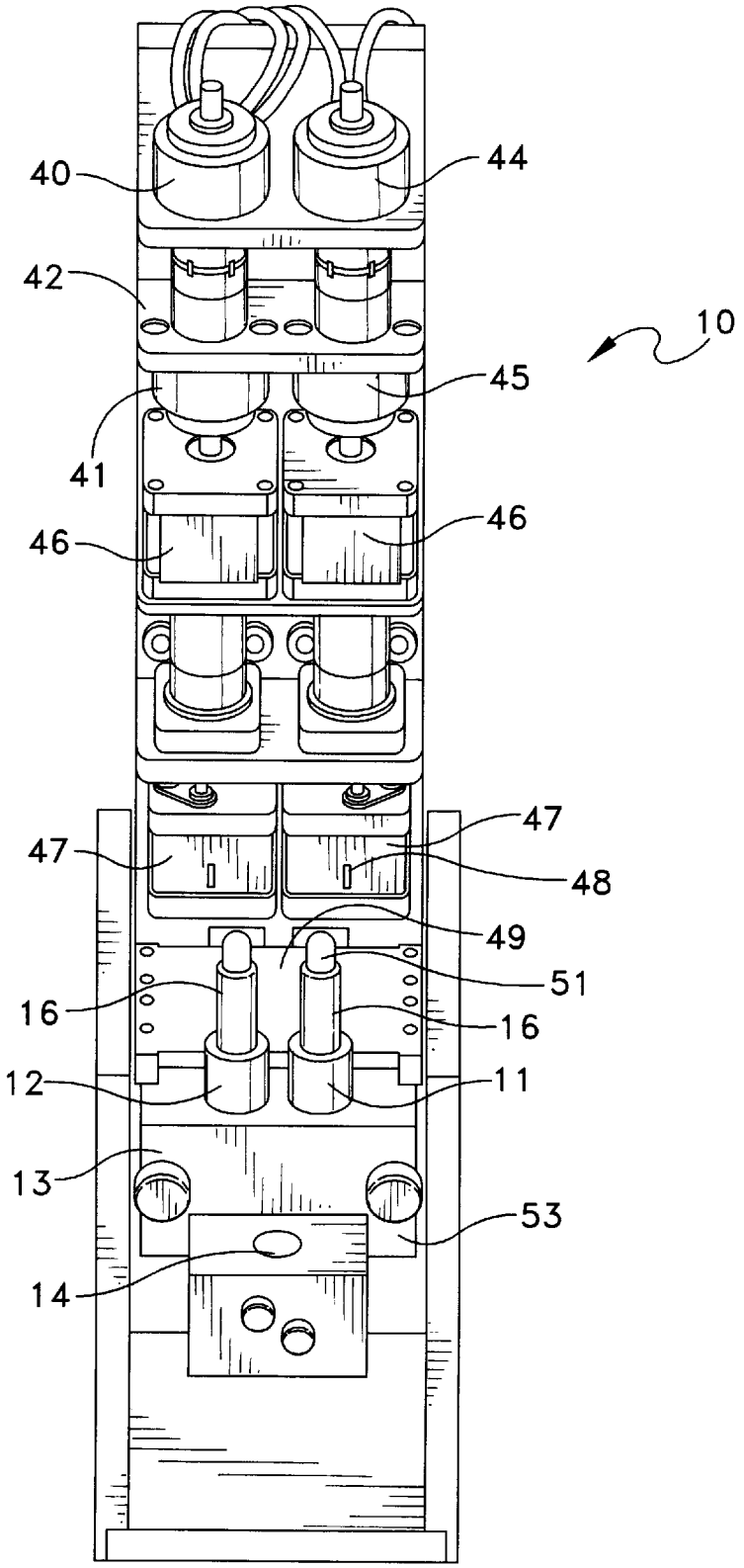
FIG. 1 depicts portions of a dispensing pump constructed in accordance with this invention.

FIG. 1 depicts a dispenser 10 that includes two sleeve assemblies including sleeves 11 and 12 attached to a manifold 13 with an input, or supply, port 14 and an output, or dispensing, port, not visible in FIG. 1 but extending oppositely from the input port 14. Each of the sleeves contains a longitudinally displaceable piston. Sleeve 11 contains piston 15; sleeve 12, a piston 16. The remaining mechanism in FIG. 1 drives the pistons 15 and 16, preferably in an alternating fashion and actuates valves such as a valve 17 shown in FIG. 2.

Figure 2:
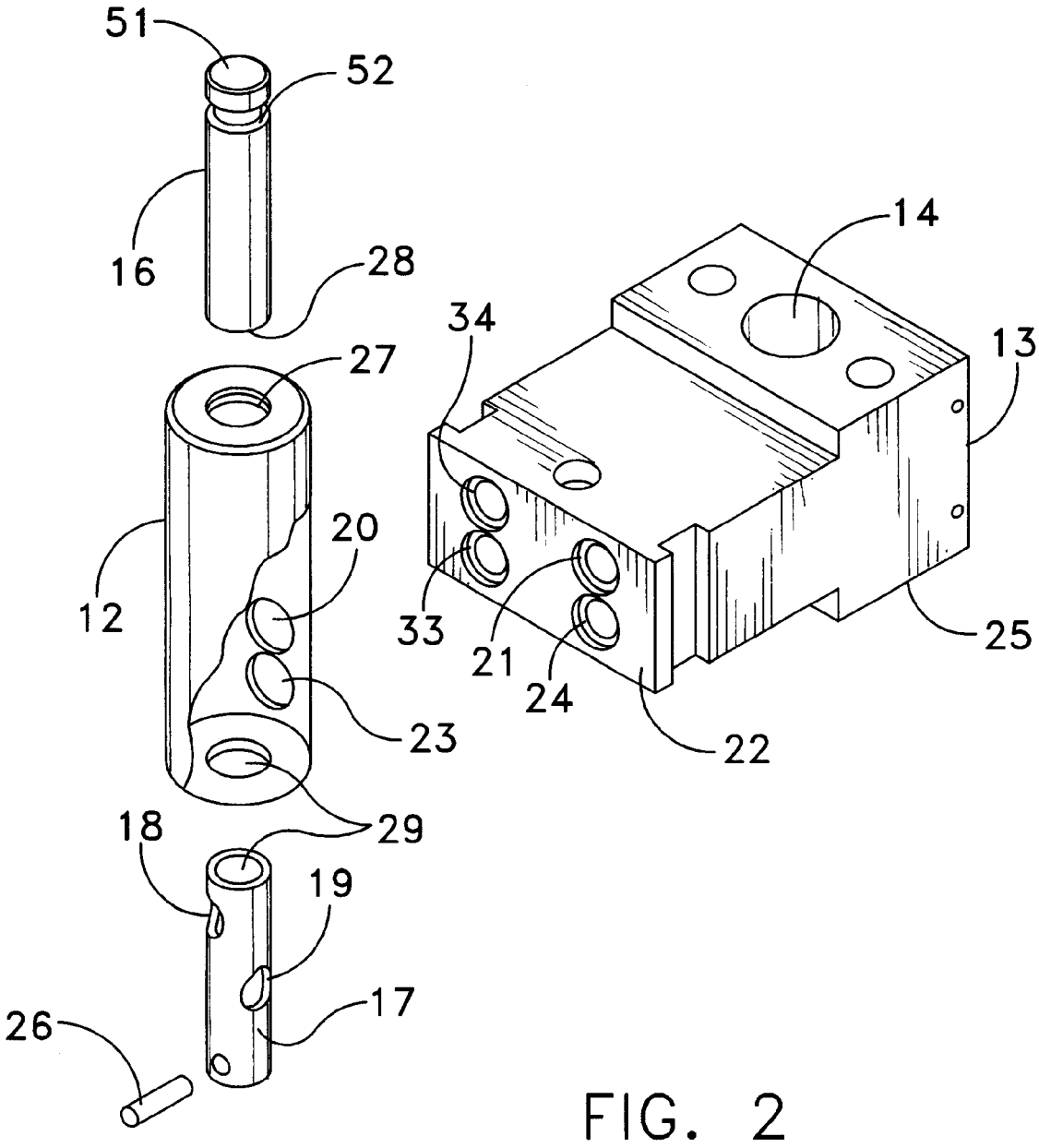
FIG. 2 is an exploded view of certain portions of the apparatus shown in FIG. 2.

Referring to FIG. 2, the valve 17 is mounted for rotation internally of the sleeve 12 at a first end or bottom of the sleeve 12 and includes angularly displaced ports shown as an input port 18 and an output port 19. In an input position of the valve 17, the input port 18 aligns with an input aperture 20 through the sleeve 12 that in turn communicates with an input passage 34 from a face 22 of the manifold 13 to the input port 14. Similarly, output port 19 allows material to be dispensed when it aligns with an output aperture 23 through the sleeve 12 that in turn aligns with an output passage 34 that communicates with the output port from a bottom surface 25 of the manifold 13. A mechanism, described later, contacts an actuator 26 to rotate the valve 17 to one of three positions namely, (1) an input position in which the input port 18 aligns with input aperture 20; (2) an output position in which the output port 19 aligns with output aperture 23; and (3) an intermediate or neutral position in which neither input port 18 or output port 19 aligns with either with input aperture 20 or output aperture 23.

The piston 16 mounts at the other end of the sleeve 12 and extends through a sealed aperture 27 and travels longitudinally between an upper position and a lower position defined when an end 28 of the piston 16 abuts an upper end 29 of the valve 17. The sealed aperture 27 prevents any material from escaping from the sleeve 11. If the piston 16 is withdrawn while the input port 18 is aligned with the input aperture 20, material displaces into the sleeve 12. When the piston 16 moves downwardly and the output port 19 aligns with the output aperture 23, material within the sleeve displaces from the sleeve 11. The volume dispensed corresponds to the volume displaced by the piston 16 during its downward travel.

Figure 3:
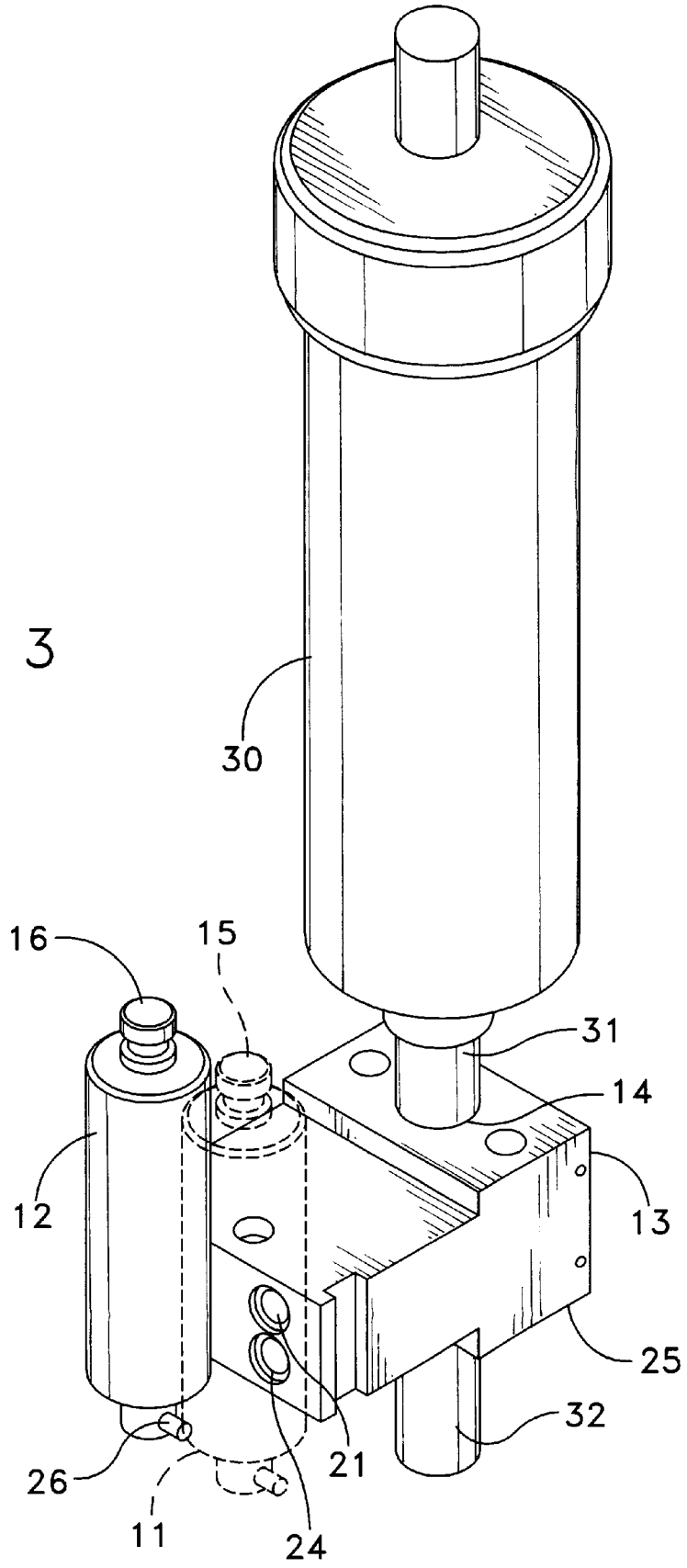
FIG. 3 is a diagram that depicts certain portions of the pump shown in FIG. 1 including the portions of FIG. 2.
Figure 4:
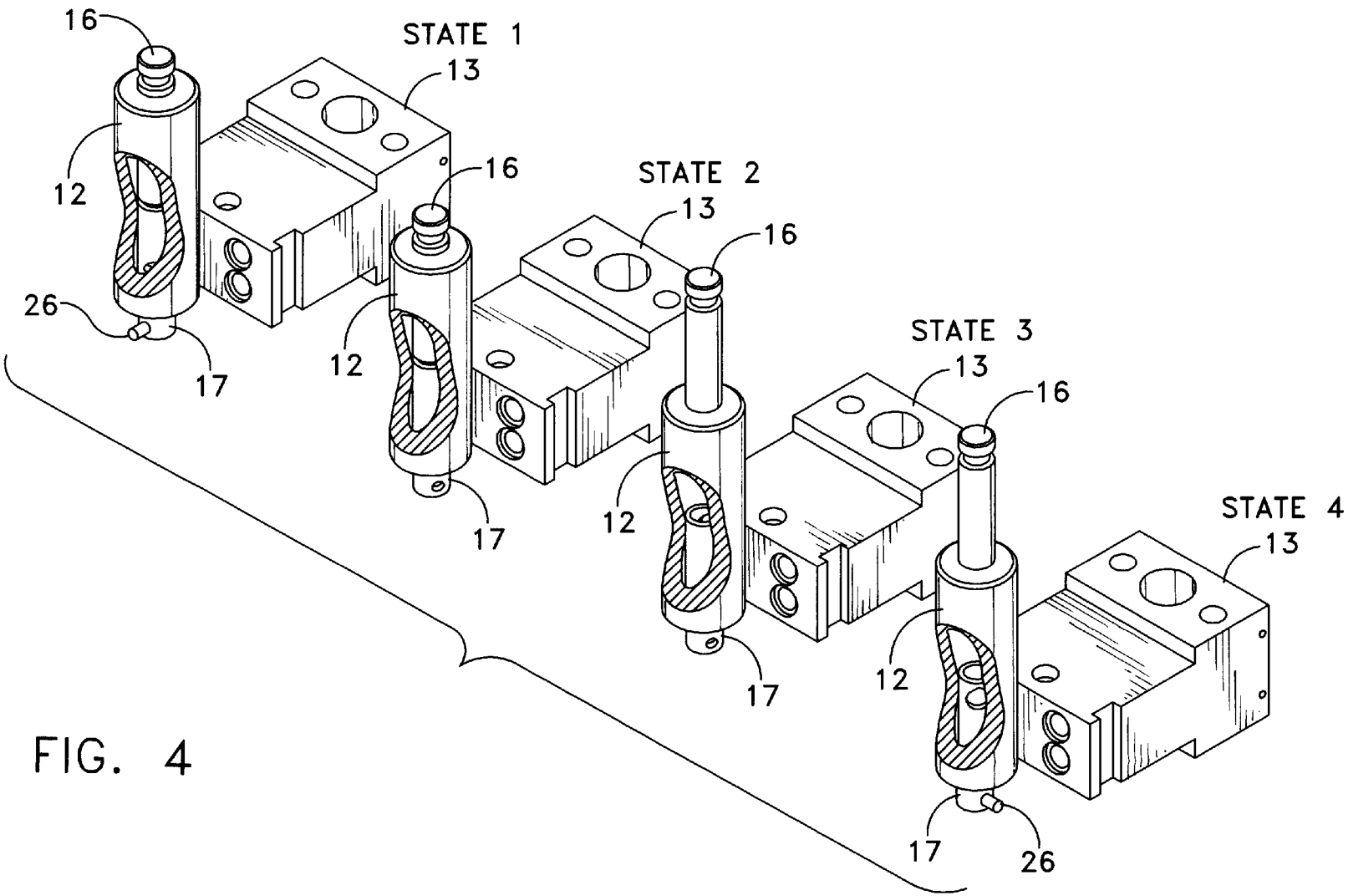
FIG. 4 depicts four states of operation of the apparatus shown in FIGS. 1 through 3.

FIG. 3 depicts in schematic form the sleeve 12 with the piston 16 attached to one side of the manifold 13 with the sleeve 11 and piston 15 being shown in phantom as attaching to passages 21 and 24 corresponding to input passage 21 and output passage 24 in FIG. 2. A supply 30, that normally is pressurized, includes a coupling 31 to the input port 14 of the manifold 13. An output coupling 32 extends from the outlet port of the manifold 13 formed in the bottom surface 25. As will be apparent a pressurized supply is preferred because it increases the efficiency of a filling operation as the piston retracts thereby to maximize the filling force in the material being admitted into the sleeve FIG. 4 more clearly depicts the operation of this dispensing system by showing in detail the operation of the assembly including the sleeve 12. At State 1 in FIG. 4, the piston 16 is fully compressed and abuts the valve 17. The operating mechanism has rotated the valve to a closed position. At State 2 the actuating mechanism rotates the valve 17 to an input position whereupon, as shown in FIG. 2, the input port 18 aligns with the input aperture 20 and the valve 17 blocks the output port 19. Then the piston 16 is withdrawn to a position as shown in State 3. Assuming that the material supplied in the sleeve 30 of FIG. 3 is incompressible and all the components involved in the transfer of the material are not compressible, withdrawing the piston 16 increases the amount of material by the volume defined by the cross-sectional area of the piston 16 and the distance it travels during its upward movement. The pressurized supply 30 assures that the material fills this volume completely.

After reaching an upper limit of travel in State 3, the mechanism actuates on the valve 17 and rotates the actuating pin 26 to the position shown as State 4. The pin 26 provides an engagement means by which the mechanism interfaces with the valve 17. This action closes the input port 18 and aligns the output port 19 in the valve 17 as shown in FIG. 2 with the output aperture 34. Next the piston 16 is driven downward back to the position shown in State 1 of FIG. 4 where the piston 16 contacts the upper edge 29 of the valve 17 or any preprogrammed position in between. An equal amount of material displaces outwardly through the output coupling 32 shown in FIG. 3. In such an application the piston 16 and valve 17 operate in a sequential or mutually exclusive fashion.

In use, and as described previously, the assemblies associated with the sleeves 11 and 12 preferably operate in an alternating fashion. That is, the upward movement of the piston 15 within the sleeve 11 enables material to enter the sleeve 11 as the piston 15 is withdrawn. Simultaneously, the piston 16 moves downward to dispense material. Upon completion of that operation the sequence reverses. The piston 16 is withdrawn while the piston 15 moves downward. As a result, the pistons associated with each of the sleeves 11 and 12 alternately eject material into the manifold 13 thereby providing a greater material throughput.

In one embodiment, the manifold 13 includes an output passage such as the output passage 24 shown in FIG. 2 with a corresponding output passage 33 as shown in FIG. 2. Similarly the second input passage 34 connects internally to the input passage 21 with both connecting to the input port 14.

Figure 5:
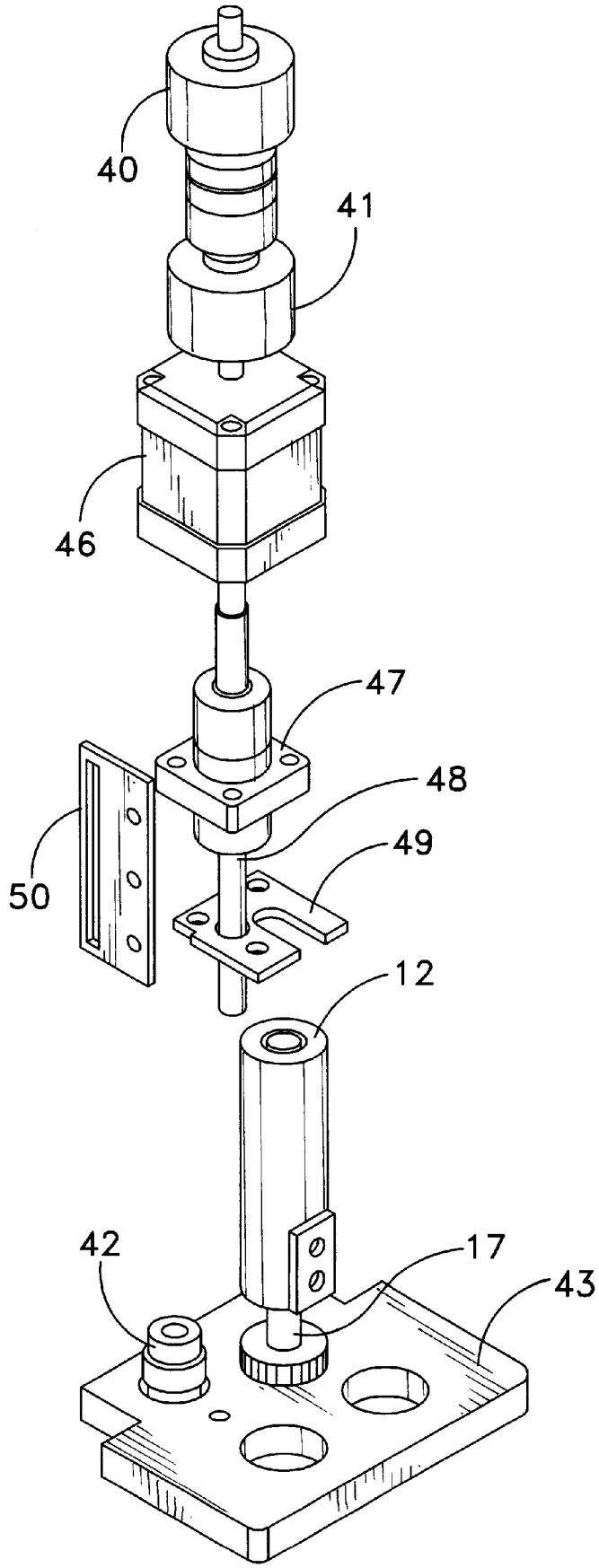
FIG. 5 is an exploded view of the system shown in FIG. 1.

Now referring to FIGS. 1 and 5, a set of rotary actuators 40 and 41 coact through shafts, typically coaxial shafts, with a gear mechanism 42 on a base plate 43 to move the actuator 26 associated with the sleeve 11. If the actuators 40 and 41 are two-position rotary actuators, one of the rotary actuators shifts the actuator 26 between its blocking position and a position for input while the other actuator 41 shifts the actuator and its valve 17 from a blocking position to a position for dispensing. A similar set of rotary actuators 44 and 45 control an identical valve inside the sleeve 11.

Still referring to FIGS. 1 and 5, a stepping motor 46 drives a nut 47 of the precision ball screw mechanism in response to rotation of the motor output shaft 48. This translates rotary motion of the stepping motor 46 into longitudinal motion of the nut 47. This nut 47 connects to a yoke 49 that carries a linear encoder 50 and that engages an upper end 51 of the piston by engaging a channel 52 shown most clearly in FIG. 2. With the linear encoder 50 serving as a feedback device, precision motion of the nut 47 and yoke 49 between any two positions, including a position defined when the piston 16 abuts the valve 17, can be obtained by conventional position control means.

A similar structure, including the rotary actuators 44 and 45 control the piston 15 and valve associated with the sleeve 11. A computer-based system or other control system, not shown, controls the operation of this apparatus, especially the rotation of the valve 17 and the longitudinal displacement of the piston 16. The design of such a system, given the disclosed inputs and outputs, is well within the capability of one of ordinary skill in the art.

As also shown in FIG. 1, a clamp 53 positions sleeves 11 and 12. This facilitates cleaning operations. As many of the materials that will be dispersed have setting times, it is often desirable to clean any mechanism contacting the material being dispensed. In the structure shown in FIGS. 1 and 5, it is merely necessary to remove the clamp 53 and snap out the sleeves 11 and 12 with their valve and pistons for cleaning.

Certain materials must be maintained at elevated temperatures. In this connection it becomes a straightforward process to apply a heating element and thermocouple to the clamp 53, manifold 13 and other related areas in order to maintain the temperature of the material at a proper temperature. Systems for providing such temperature control are also well known in the art.

The foregoing operation has been described in terms of dispensing a one-part material. If the manifold is modified so that each of the input passages, such as the input passages 21 and 24, are routed to separate input ports that in turn are coupled to receive the two parts of the mixture, the pistons can operate in tandem thereby to pump the two parts through the passages 24 and 33 to be mixed as they move toward the output coupling.

Therefore, there has been described in the foregoing figures a dispenser that is readily adapted for high volume work including a wide variety of materials to be dispensed. Accuracy and repeatability in the volume dispensed is achieved by the use of the individual cylinders, such as sleeves 11 and 12, and the control of piston displacement through conventional, but high-precision positioning systems. The sleeves, valves and pistons can all be composed of materials that are adapted to withstand the environment of a particular material. However, even if wear occurs, it will be apparent that it is a simple matter to replace those mechanisms without having to undertake any major maintenance functions.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by letters patent of the united states is:

1. A dispensing pump comprising:

A. a sleeve having first and second ends and first and second spaced apertures through a side thereof, B. a valve mounted for rotation internally at a first end of said sleeve with first and second ports for alignment with said first and second apertures in first and second angular positions of said valve, respectively, C. a piston mounted at the other end of said sleeve for longitudinal motion between a first position abutting said valve and a second position displaced from said valve, and D. control means for rotating said valve and displacing said piston thereby to dispense a material from one of said spaced apertures.

2. A dispensing pump as recited in claim 1 wherein said sleeve has a sealed passage at said first end through which a portion of said valve extends, said valve portion including means for being engaged by said control means.

3. A dispensing pump as recited in claim 2 wherein said sleeve has a sealed passage at said second end through which a portion of said piston extends, said piston including means for being engaged by said control means.

4. A dispensing pump as recited in claim 3 additionally comprising a manifold including a supply port and a dispensing port, said first and second spaced apertures in said sleeve aligning with said supply and exit ports, respectively.

5. A dispensing pump as recited in claim 4 wherein said valve ports are angularly spaced, said first port being aligned with said supply port in said first position of said valve whereby displacement of said piston from said valve enables a predetermined quantity of material to move into said dispenser.

6. A dispensing pump as recited in claim 4 wherein said valve ports are angularly spaced, said second port being aligned with said dispensing port in said second position of said valve whereby displacement of said piston toward said valve moves a predetermined quantity of material out of said dispenser through said dispensing port.

7. A dispensing pump as recited in claim 1 wherein the volume displaced when said piston moves between its positions determines the volume of material that is dispensed through said dispensing port.

8. A dispensing pump as recited in claim 1 wherein said valve blocks said first and second spaced apertures in said sleeve when said valve is at an intermediate position.

9. A dispensing pump as recited in claim 1 wherein said control means rotates and valve and displaces said piston in a mutually exclusive fashion.

10. A dispensing pump comprising:

A. a manifold having an input port for connection to a material source, an output port and first and second input and output passages wherein said input passages connect to said input port and said output passages connect to said output port, B. first and second sleeve assemblies, each said sleeve assembly attached to communicate with one pair of said input and output passages and having means for displacing material, and C. means for operating said displacing means for moving material from the material source through said input passages and input ports into said sleeve assemblies and for moving material from said sleeve assemblies through the output ports and output passages.

11. A dispensing pump as recited in claim 10 wherein each of said first and second sleeve assemblies includes:

i. a sleeve having first and second ends and first and second spaced apertures through a side thereof, ii. a valve mounted for rotation internally at a first end of said sleeve with first and second ports for alignment with said first and second apertures in first and second angular positions of said valve, respectively, iii. a piston mounted at the other end of said sleeve for longitudinal motion between a first position abutting said valve and a second position displaced from said valve.

12. A dispensing pump as recited in claim 11 wherein said sleeve has a sealed passage at said first end through which a portion of said valve extends, said valve portion including means for being engaged by said control means.

13. A dispensing pump as recited in claim 12 wherein said sleeve has a sealed passage at said second end through which a portion of said piston extends, said piston including means for being engaged by said control means.

14. A dispensing pump as recited in claim 13 additionally comprising a manifold including a supply port and a dispensing port, said first and second spaced apertures in said sleeve aligning with said supply and exit ports, respectively.

15. A dispensing pump as recited in claim 14 wherein said valve ports are angularly spaced, said first port being aligned with said supply port in said first position of said valve whereby displacement of said piston from said valve enables a predetermined quantity of material to move into said dispenser.

16. A dispensing pump as recited in claim 14 wherein said valve ports are angularly spaced, said second port being aligned with said dispensing port in said second position of said valve whereby displacement of said piston toward said valve moves a predetermined quantity of material out of said dispenser through said dispensing port.

17. A dispensing pump as recited in claim 11 wherein the volume displaced when said piston moves between its positions determines the volume of material that is dispensed through said dispensing port.

18. A dispensing pump as recited in claim 11 wherein said valve blocks said first and second spaced apertures in said sleeve when said valve is at an intermediate position.

19. A dispensing pump as recited in claim 11 wherein said control means rotates and valve and displaces said piston in a mutually exclusive fashion.

* * * * *